US006493995B2

(12) United States Patent
McKenzie

(10) Patent No.: US 6,493,995 B2
(45) Date of Patent: Dec. 17, 2002

(54) MODULAR EXHIBIT PANEL AND LOCKING SYSTEM

(76) Inventor: Alexander L. McKenzie, 14803 Vanowen St., Van Nuys, CA (US) 91405

( * ) Notice: Subject to any disclaimer, the term of this patent is extended or adjusted under 35 U.S.C. 154(b) by 0 days.

(21) Appl. No.: 09/920,510

(22) Filed: Aug. 1, 2001

(65) Prior Publication Data

US 2002/0020120 A1 Feb. 21, 2002

Related U.S. Application Data

(60) Provisional application No. 60/227,060, filed on Aug. 21, 2000.

(51) Int. Cl.[7] ..... E04C 2/52

(52) U.S. Cl. ..... 52/36.4; 52/36.1; 52/239; 52/282.2; 52/220.7; 52/284; 52/241

(58) Field of Search ..... 52/241, 238.1, 52/282.2, 587.1, 461, 284, 36.4

(56) References Cited

U.S. PATENT DOCUMENTS

| | | | | | |
|---|---|---|---|---|---|
| 2,414,060 | A | * | 1/1947 | Rausch | 20/4 |
| 2,453,221 | A | * | 11/1948 | Haden | 20/4 |
| 3,466,777 | A | | 9/1969 | Wistrand et al. | |
| 3,766,692 | A | | 10/1973 | Stark et al. | |
| 3,802,146 | A | | 4/1974 | Tacke et al. | |
| 3,847,489 | A | * | 11/1974 | Van Riper | 403/110 |
| 4,047,342 | A | | 9/1977 | Boulva | |
| 4,135,775 | A | * | 1/1979 | Driscoll | 339/22 R |
| 4,416,093 | A | | 11/1983 | Salkeld et al. | |
| 4,712,336 | A | | 12/1987 | Backer | |
| 4,942,709 | A | | 7/1990 | Waldron | |
| 4,986,038 | A | | 1/1991 | Becker | |
| 5,097,643 | A | | 3/1992 | Wittler | |
| 5,219,406 | A | | 6/1993 | Raz | |
| 5,287,909 | A | * | 2/1994 | King et al. | 160/135 |
| 5,305,567 | A | | 4/1994 | Wittler | |
| 5,381,845 | A | | 1/1995 | Ruggie et al. | |
| 5,421,112 | A | | 6/1995 | Knorr | |
| 5,546,720 | A | | 8/1996 | LaBruzza | |
| 5,715,633 | A | | 2/1998 | Raz et al. | |
| 6,209,273 | B1 | * | 4/2001 | Jeffers et al. | 52/220.7 |
| 6,295,764 | B1 | * | 10/2001 | Berridge et al. | 52/36.5 |
| 6,339,907 | B1 | * | 1/2002 | Dame et al. | 52/239 |

* cited by examiner

*Primary Examiner*—Yvonne M. Horton
*Assistant Examiner*—Basil Katcheves
(74) *Attorney, Agent, or Firm*—Kelly Bauersfeld Lowry & Kelley, LLP

(57) ABSTRACT

A modular exhibit panel and lock system includes a first wedge secured within a first channel of a first object, such as a modular exhibit panel. A second wedge is secured within a second channel of a second object, such as a second panel. The first and second objects are securely associated with one another by placing the first wedge in the first channel, and the second wedge in the second channel in an orientation generally opposite of a first wedge and sliding the first and second channel relative to one another so that the first and second wedges interlock causing the first and second objects to be connected to one another. A multi-faceted panel connector having channels in at least two facets thereof, and a third wedge within these channels, can be used to securely associate panels of the system with one another.

25 Claims, 11 Drawing Sheets

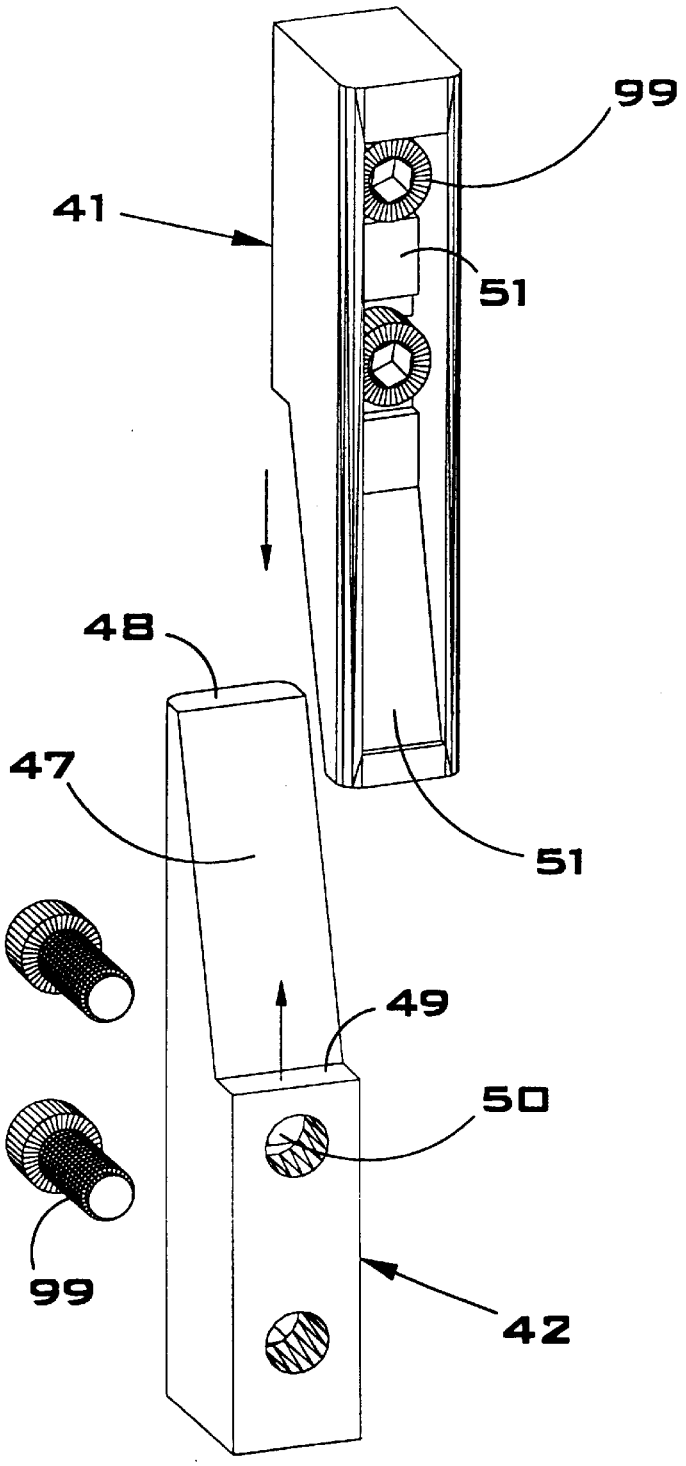
FIG. 2
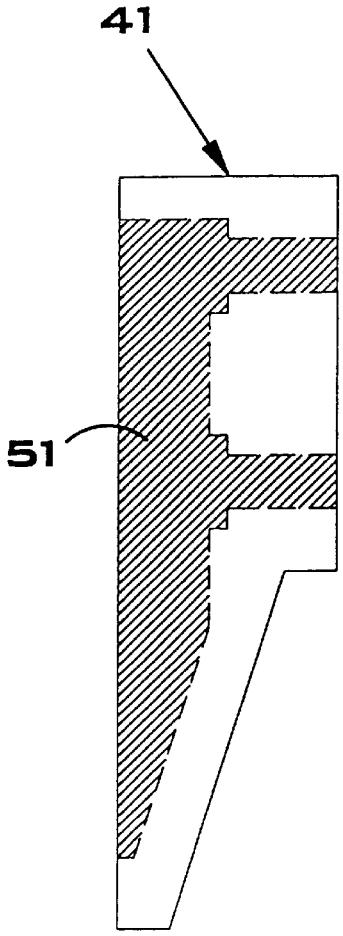
FIG. 2-A

MODULAR EXHIBIT PANEL AND LOCKING SYSTEM

RELATED APPLICATION

This application claims priority from provisional application Ser. No. 60/227,060 filed Aug. 21, 2000.

BACKGROUND OF THE INVENTION

The present invention relates generally to locking systems and prefabricated modular exhibit systems or partitions assemblies used by exhibitors at trade shows, exhibitions, art galleries and conventions to advertise and promote their products and goods. More particularly, the present invention relates to a prefabricated modular exhibit system which achieves a seamless variable surfaced wall capable of many heights and angles while permitting cables, such as electrical or telephone cables, to be channeled therethrough.

Modular exhibit structures are constructed to offer a wide variety of configurations, to be light in weight, and to reduce shipping costs. Modular exhibit structures are also constructed so that they can be easily assembled, dismantled and shipped to another location and reassembled, time after time. It has been standard practice to join wall panels together by clips, bolts, latch and receiver fasteners or other fastening means. However there are problems with the existing fasteners. Most clips mentioned in prior art wall panel connectors are inserted from the top and or bottom of the wall panel. While this method is effective in holding wall panels together, they do not, however, connect in the middle of the wall panel. Thus, the wall panel is rendered less stable and visually unappealing.

Latch and receiver fasteners are used to achieve good medial contact between two walls panels, however a tool must be inserted into the front or rear surfaces of the wall panel thus creating a hole in one or both surfaces in order to access the fastener. Many users of this fastening method have used small circle plugs of various materials to cover up these holes.

Bolts have also been used to connect wall panels together and provide a great amount of medial contact, however all wall panels constructed in this manner are single sided and therefore less versatile.

U.S. Pat. No. 5,546,720 to La Bruzza discloses a panel system in which adjacent panels are removably joined at their edges and which includes a pair of substantially identical clips, each of which is affixed to an edge of a panel. Each clip includes a base portion and a body portion extending from the base portion in a generally perpendicular direction. However, the LaBruzza panel system is not easy to mold or extrude and has been found to be insufficiently strong and rigid. Moreover, the panel system of LaBruzza is complex and expensive to produce.

Prior art exhibit system wall panels also have levelers to adjust the height of wall panels enabling all panels to be adjusted level to the floor. With small adjustable nut plates attached to the levelers, or in some cases no adjustable plates, leveling wall panels after they are in place has proven to be very complicated if not impossible. Most nut plates are no larger than three- eights of an inch, limiting adjustment due to the small size of a typical three-eights inch wrench used in the process. Prior attempts to provide a strong and sturdy leveler have not been completely successful.

Existing prior art exhibit system wall panels also have the disadvantage of having either no electrical wiring or pre-wired electrical wiring installed inside designated wall panels. However, having pre-wired electrical wiring within the wall panels has proven to be problematic when changing the location of required electrical on exhibits as such systems require the relocation of an entire wall panel. This can be time consuming and costly.

Accordingly, there is a need for a locking system which is sufficiently rigid and strong, while simple to use and inexpensive to produce. There is also a need for a prefabricated modular wall exhibit system which joins panels and partitions with tight medial contact between panels without special tools in a seamless and aesthetically pleasing manner while providing sufficient structural rigidity. Such a panel system should enable exhibit builders the ability to make last minute changes on the show floor by adding electrical extension cords and telephone cables within each panel frame. What is also needed is a locking system which enables a user to hang prefabricated wall panels of great size and weight to other similar panels with relative ease. Such a paneling system should be versatile by allowing a user to choose multiple interior material configurations within the panels. The present invention fulfills these needs and provides other related advantages.

SUMMARY OF THE INVENTION

The present invention resides in a locking system comprises a first wedge secured within a first channel of a first object, and a second wedge secured within a second channel of a second object. The first wedge is placed in the first channel such that the finger is downwardly directed, and the second wedge is placed in the second channel such that the finger is directed upwardly so that upon sliding the first and second channels relative to one another, the first and second wedges interlock with one another causing the first and second objects to be connected.

The first wedge includes a base secured to an inner wall of the first channel, and a tapered finger extending from the base. The finger and base cooperatively form a ledge. The second wedge is substantially identical to the first wedge and includes a base secured to an inner wall of the second channel and a tapered finger extending from the base, a finger and base forming a ledge. The first and second wedges also include apertures for acceptance of a bolt therethrough and into the first and second channels to securely hold the first and second wedges in place within the first and second channels. Preferably, the first and second wedges also include a cavity to provide structural strength when the wedges are comprised of a non-metallic material, such as plastic.

In a particularly preferred embodiment of the present invention, the first and second objects comprise either a modular exhibit panel or an elongated panel connector. Each panel includes an outer frame comprised of hollow internal and external vertical members slidably connected to one another, and hollow internal and external horizontal members slidably connected to one another. The horizontal and vertical members are arranged to form the frame, typically in a rectangular shape. The internal horizontal and vertical members include an open-face channel directed into the frame that serves to securely receive wall panel composites and the like. The external horizontal and vertical members also include an open-face channel directed outward with respect to the frame which comprises the previously mentioned channels housing the wedges.

The external horizontal open-faced channels are configured to received electrical or telephone cables, and the external horizontal members include an aperture positioned over an internal vertical member for the insertion of electrical or telephone cable into the hollow vertical member. The external horizontal members also include apertures configured to securely receive a foot member, which is preferably adjustable in height.

The panel connector is multi-faceted and includes an open-faced channel in at least two facets thereof. A third wedge, which is substantially similar to the first and second wedges, is secured within the open-faced channel of the panel connector. The panel connector preferably includes projections extending from an internal wall of the channel for securing the wedge within the channel. The panel connector also includes a central aperture and a plurality of projections extending into the central aperture to facilitate a frictional fit with a foot member, or either a vertical extension member so that the panel connectors can be stacked upon one another to effectively heighten the panel system.

Thus, to securely associate first and second panels with one another, the first wedge in the first outwardly directed channel of a vertical member of a first panel frame is place in an orientation generally opposite a third wedge within the panel connector channel. The second wedge is place in a second outwardly directed channel of the vertical member of a second panel frame so as to be oriented generally opposite the third wedge within the panel connector channel. Upon sliding the first outwardly directed channel of the vertical member of the first panel frame and second outwardly directed channel of the vertical member of the second panel frame relative to the panel connector channels, the first and second wedges interlock with the third wedges causing the first and second panels to be connected to the panel connector. Edges of the first and second panels or panel connectors can be similarly connected.

Such a modular exhibit panel and locking system is relatively inexpensive to produce, achieves a seamless variable surface wall capable of many heights and angles while permitting cables to be channeled therethrough. Due to the fact that the panel partitions are joined not only at the ends, but also within the middle of the wall panel, the system achieves outstanding structural rigidity. The system is able to be easily adjusted and leveled in an effortless manner.

Other features and advantages of the present invention will become apparent from the following more detailed description, taken in conjunction with the accompanied drawings which illustrate by way of example, the principles of the invention.

BRIEF DESCRIPTION OF THE DRAWINGS

The accompanying drawings illustrate the invention. In such drawings:

FIG. 2 is a perspective view of top and bottom wedge locks and corresponding mounting screws used in accordance with the present invention;

FIG. 2-A is a cut-away view of top wedge lock illustrating a cored out cavity area;

DETAILED DESCRIPTION OF THE PREFERRED EMBODIMENTS

Figure 1:
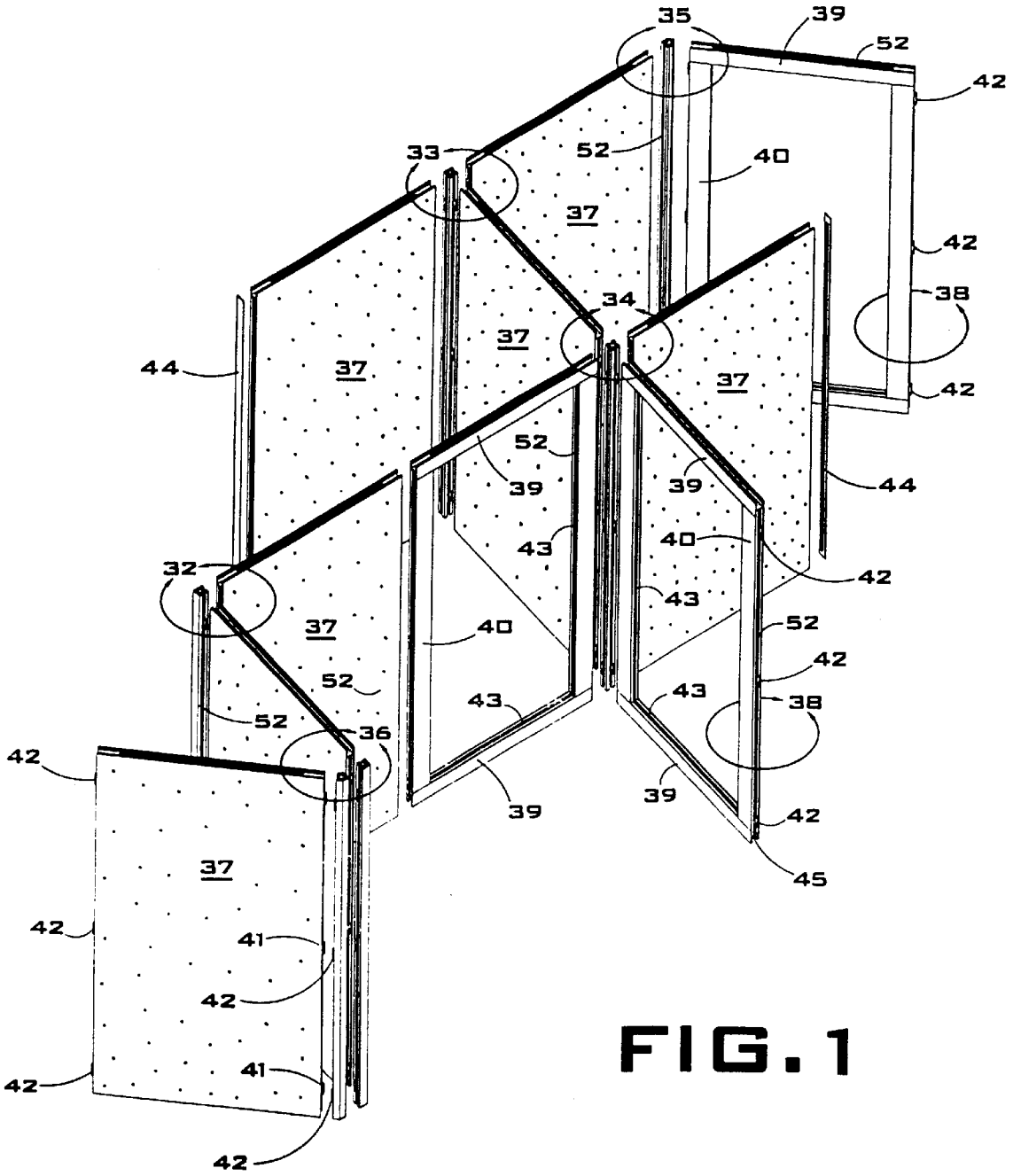
FIG. 1 is a perspective view of an arrangement of exhibit panels embodying the present invention and positioned to be connected to one another with right angled upright panel connectors.

As shown in the drawings for purpose of illustration, the present invention is concerned with a prefabricated modular exhibit panel and lock system, illustrated in the accompanying drawings. With reference to FIG. 1, major components of the system of the invention are solid panels 37 framed panels 38 and panel frame members 39 and 40 and the production and assembly thereof.

Figure 6:
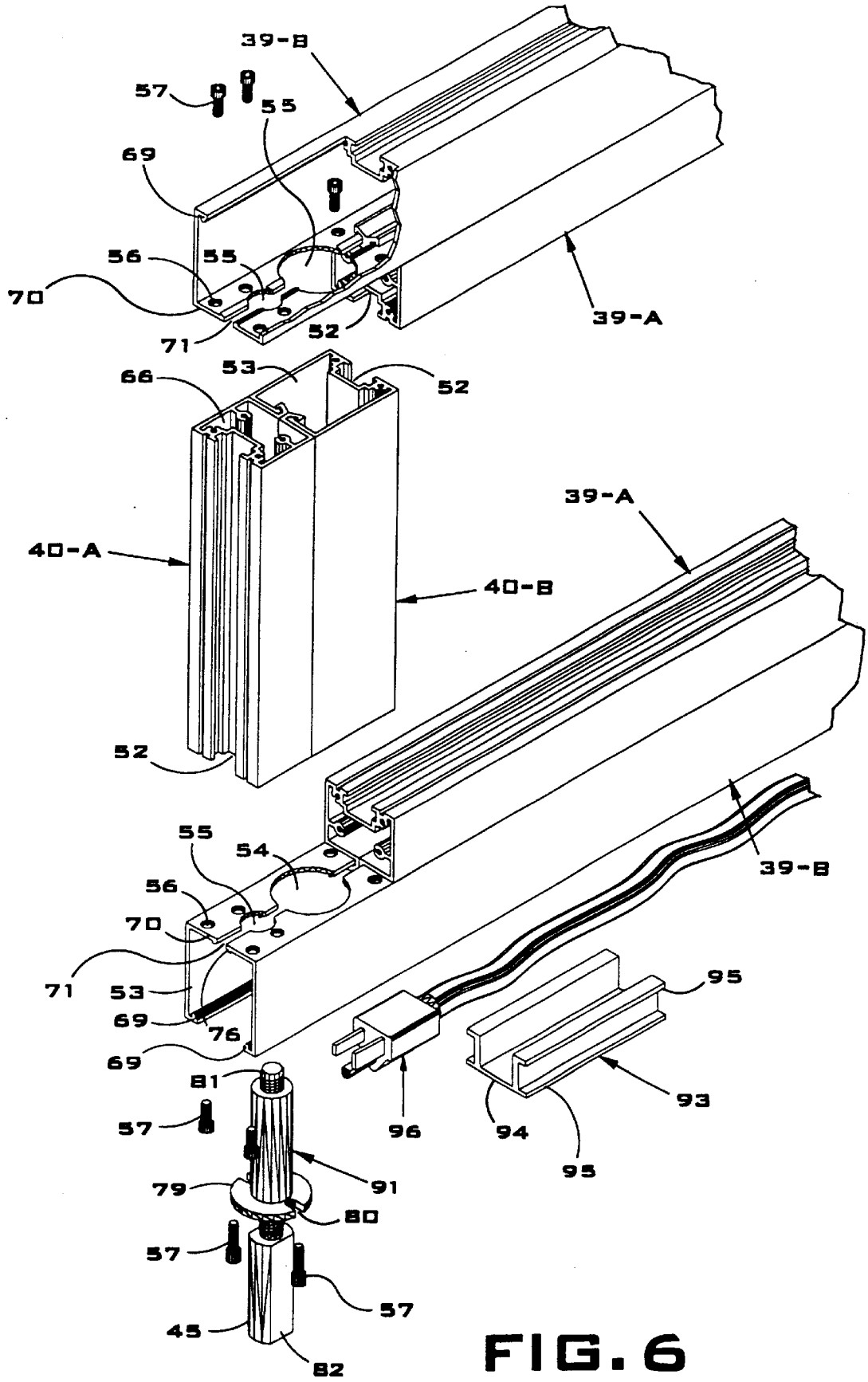
FIG. 6 is a perspective view of two rigid frame profiles with adjustable foot, foot sleeve and electrical access cap in accordance with the present invention.

The horizontal 39 and vertical 40 frame members are composed from two extrusions, preferably produced by manufacturing a die in which rigid polyvinyl chloride (PCV) plastics are extruded through. This results in one rigid PVC extruded plastic profile. PVC plastics are rigid, lightweight, and fire resistant to insure a non-flammable product. Although PVC plastics an extrusion thereof is a preferred form of creating horizontal and vertical frame members 39 and 40, it is to be understood that such frame members 39 and 40 can be comprised of other materials and methods while retaining the same general configuration. The vertical profile 40-A and horizontal profile 39-A are identical in shape and are produced from the same die in which they are extruded. Vertical profile 40-B and horizontal profile 39-B are also identical and are produced from an additional die. By combining one of each profile, horizontal 39 and vertical 40 frame members are achieved. The top and bottom horizontal frame members 39-B are securely joined to the vertical frame members 40-A and 40-B. These are then secured by assembly screws 57, as illustrated in FIGS. 6 and 7.

Figure 4:
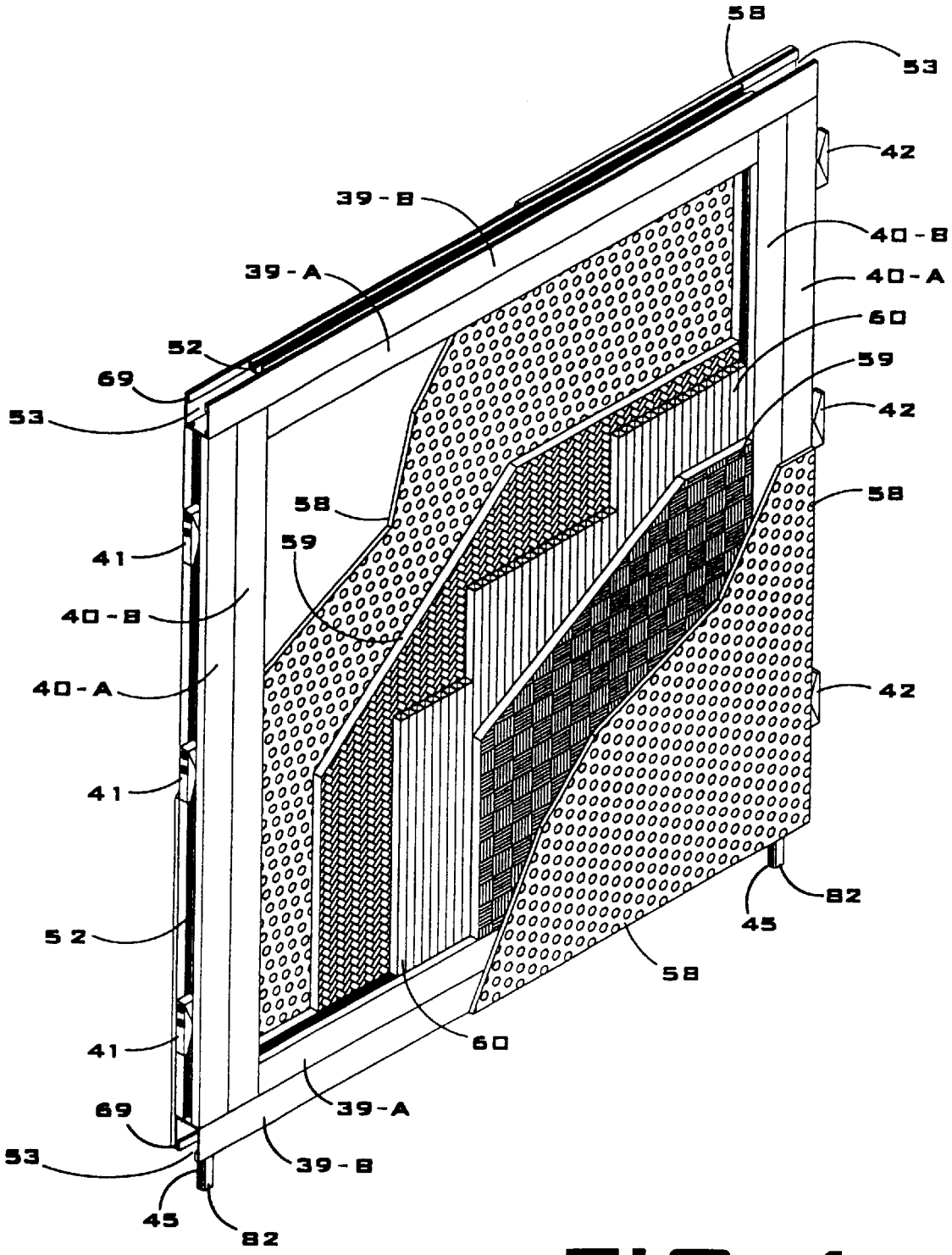
FIG. 4 is a fragmented cut- away view of a solid wall panel of the present invention illustrating placement of the interior and exterior materials thereof.
Figure 5:
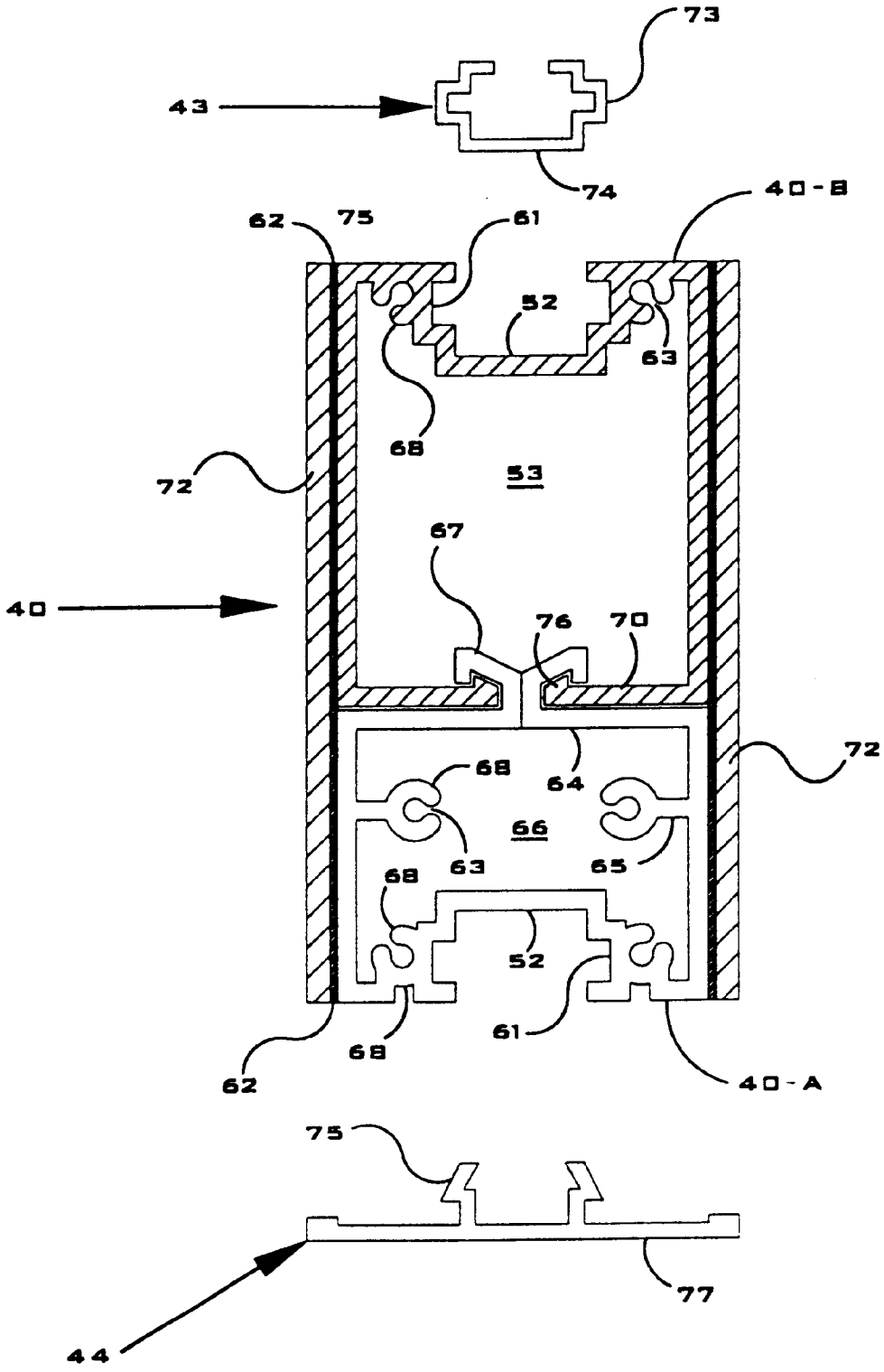
FIG. 5 is a top cross-sectional view of a panel frame member composition with two rigid open-end extrusions, panel end cap and glass retainer used in accordance with the present invention.
Figure 16:
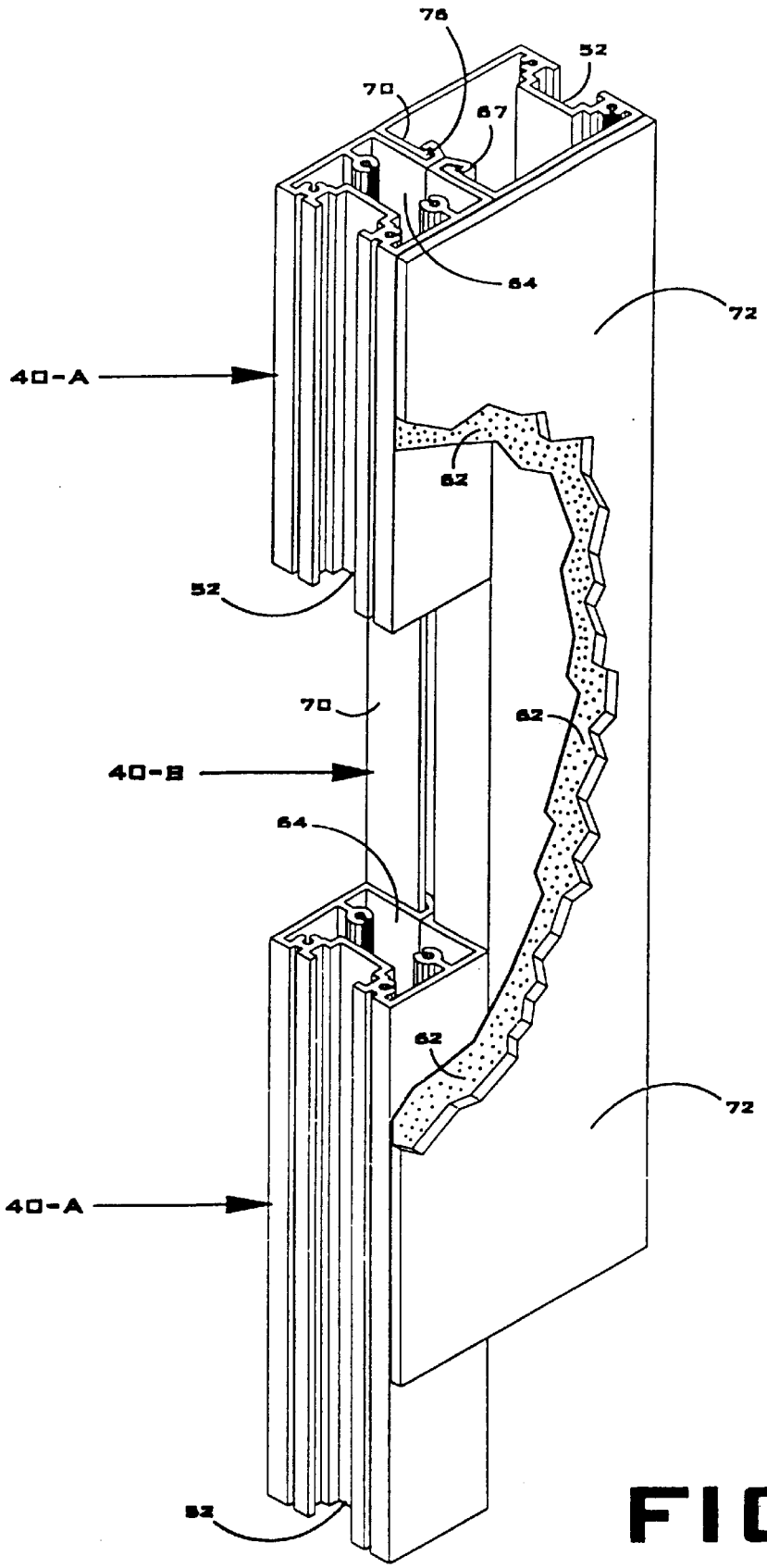
FIG. 16 is a perspective view of a two part extruded frame profiles, illustrating one internal vertical member profile merging into two exterior members.

Referring to FIGS. 5 and 16. the intricate compound shape of profiles 40-A and 40-B allow several pieces of scrap profile to be joined together. Profile 40-B possesses a divider wall 70 with a tapered flange 76 and cutaway channel 71 that slides and is secured into the profile 40-A receiver groove 67. This procedure allows solid panels 37 and framed panels 38 to be lengthened to great extents. The overall strength of the framed panel 38 gains it's strength when profiles 40-A and 40-B and scrap pieces thereof are combined with contact adhesive 62 and polyvinyl chloride strip 72, as illustrated in FIG. 4, thus rendering a framed panel composite.

The use of PVC frame member profiles which slide relative to one another allows ease of lengthening both vertical and horizontal frame members indefinitely and minimizes waste of material. In fact, as illustrated in FIG. 16, several pieces of either and internal or external frame member may be interconnected with a single piece, or even multiple pieces, of the mating member so long as the points of connection do not align with one another. Thus, waste is virtually eliminated as even small sections of the PVC can be used to construct the frame and panel.

Figure 7:
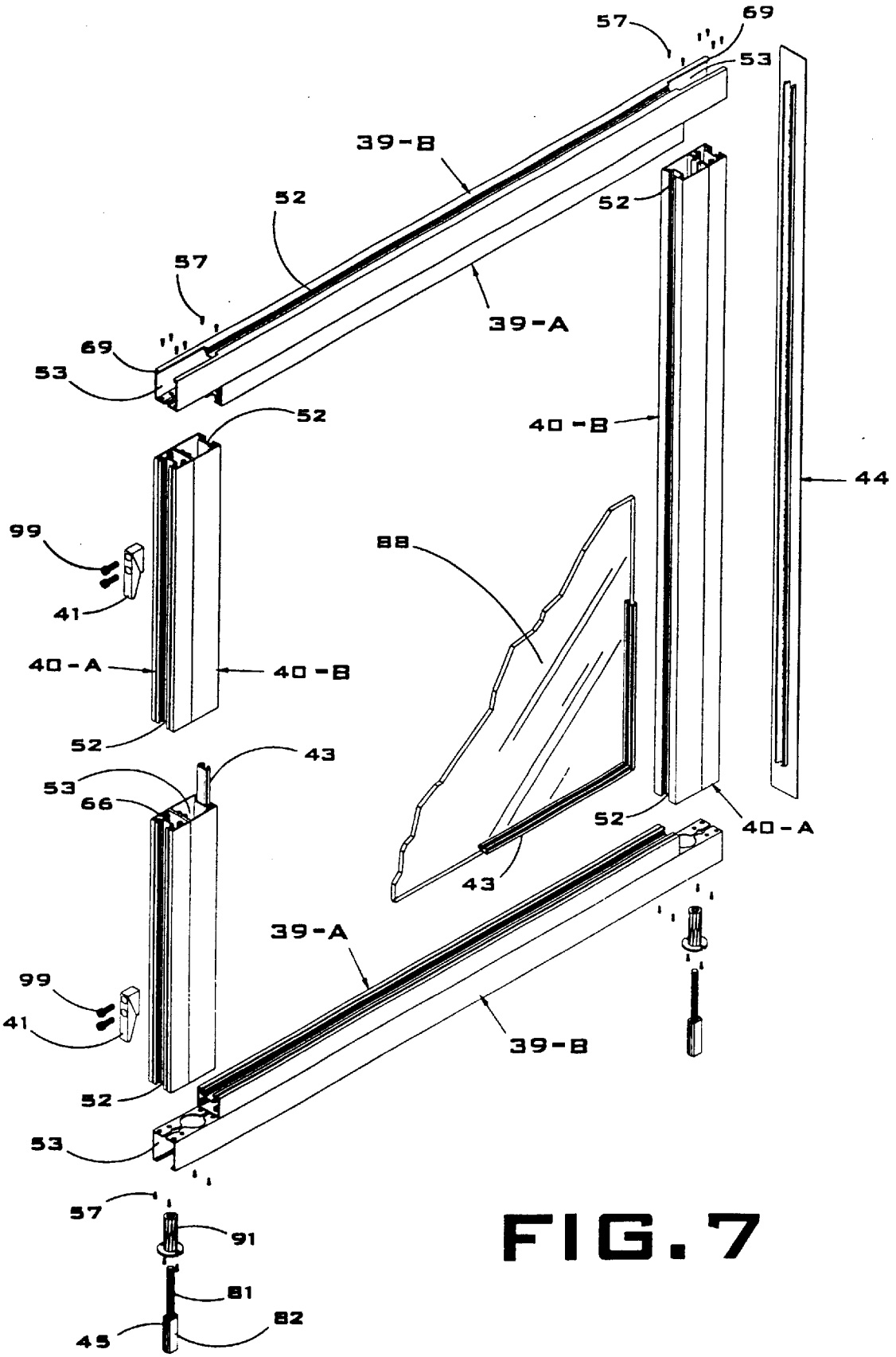
FIG. 7 is a partially fragmented perspective view of a framed glass panel with foot sleeve, adjustable foot, glass retainer and panel end cap in accordance with the present invention.

Referring to FIGS. 5 and 7, in addition to producing a composite panel, glass or clear non-flammable plastics can also be inserted into the concave channel providing a transparent wall panel. Prior to tightening the frame assembly screws 57, glass retainer 43 having wall 74 and stops 73 is inserted into channel 52 and slot 61 of the horizontal and vertical profiles. The glass panel 88 is then secured into the glass retainer 43 providing a secure fit.

Referring to FIGS. 4 and 7, prior to tightening the frame assembly screws 57, a center core panel 60 is inserted into a continuous channel 52 located on the interior of all horizontal 39-A and vertical 40-B frame members. The location of the center core panel 60 provides for a true right angle alignment and adds additional strength to the panel 37.

Once the center core panel 60 is in place, the vertical profiles 40-A, 40-B and horizontal profiles 39-A and 39-B are securely fastened by the assembly screws 57. Assembly screws 57 are inserted through the horizontal profile 39-B assembly holes 56 and into the grooves 63 of track 65 and 68 located in the vertical profile 40-A and 40-B. There are two continuous grooves 63 located directly adjacent the electrical access channel 53 at opposite ends of the profile.

Figure 8:
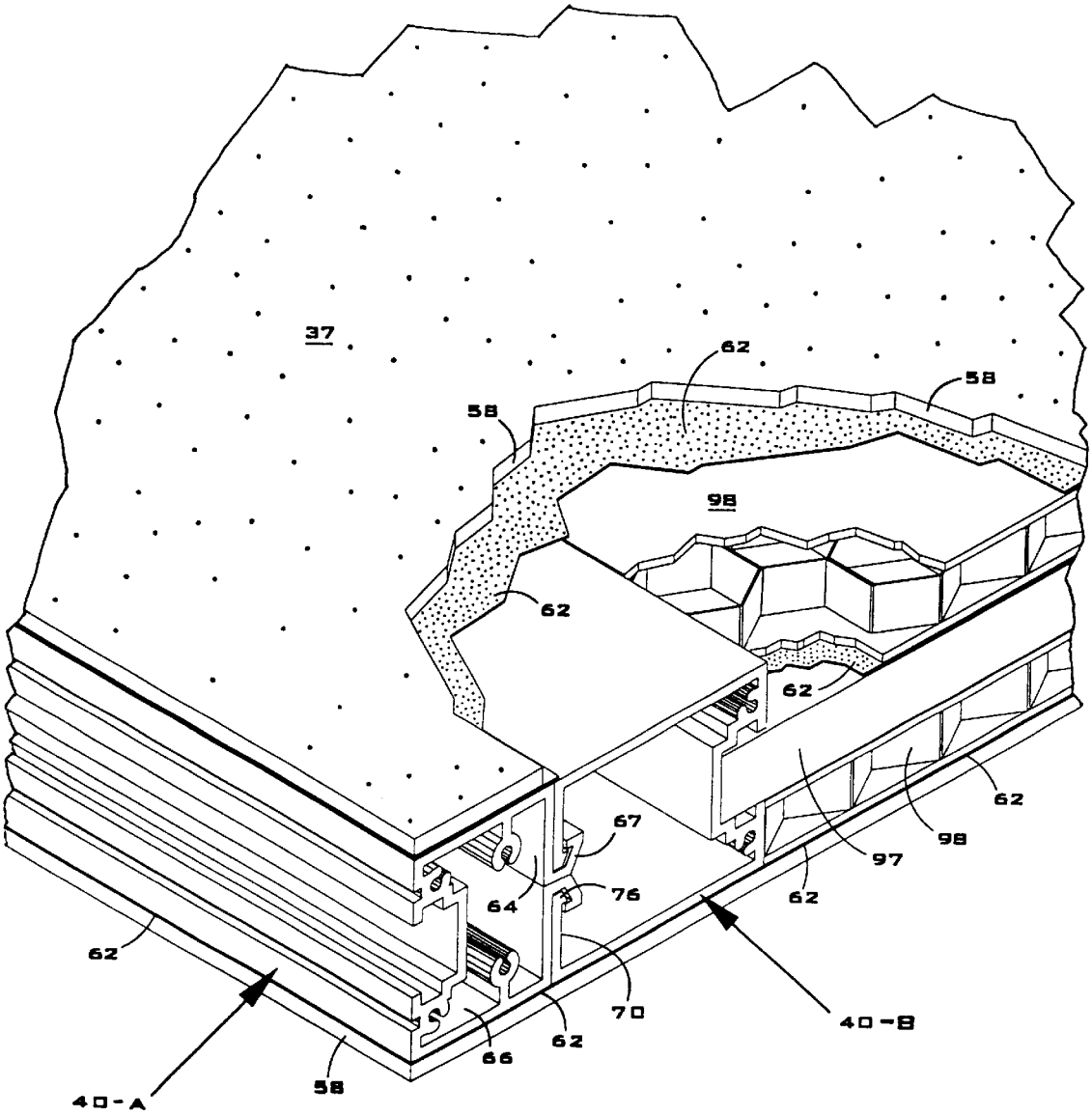
FIG. 8 is a partially fragmented view of a panel composite illustrating an exterior surface, multi-layer filling and contact adhesive.
Figure 9:
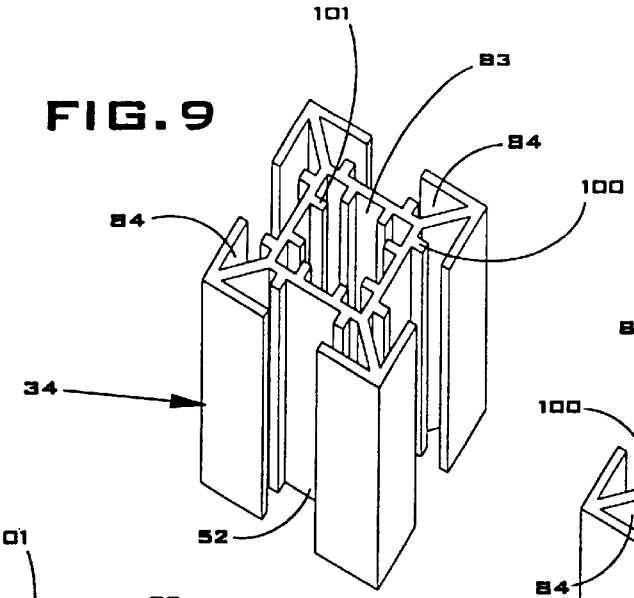
FIG. 9 is a perspective of a four-way right angle upright panel connector.
Figure 10:
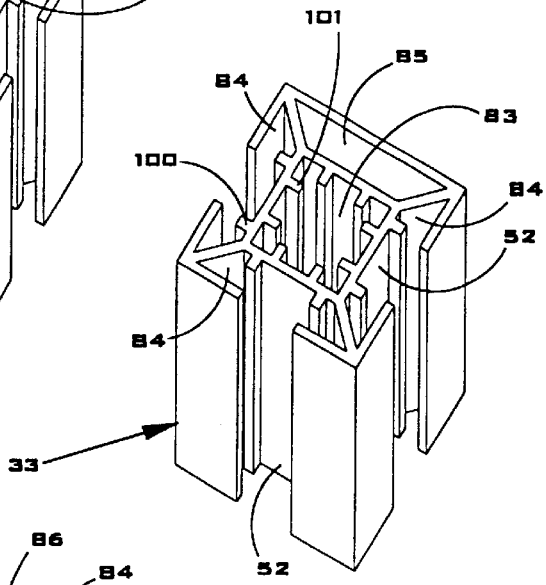
FIG. 10 is a perspective view of a three-way right angle upright panel connector.
Figure 11:
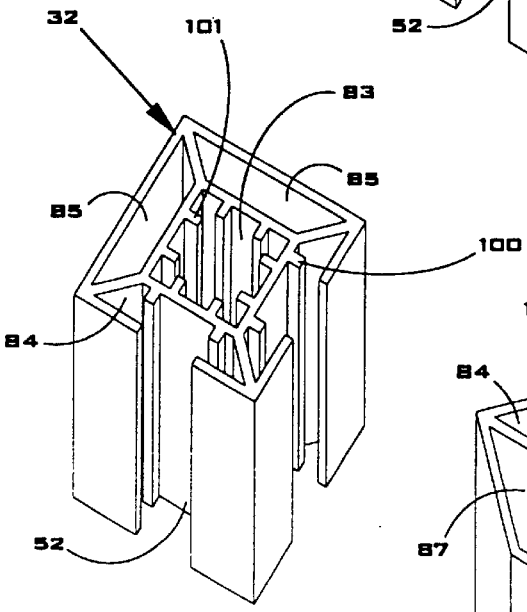
FIG. 11 is a perspective view of a two-way right angle panel connector.
Figure 12:
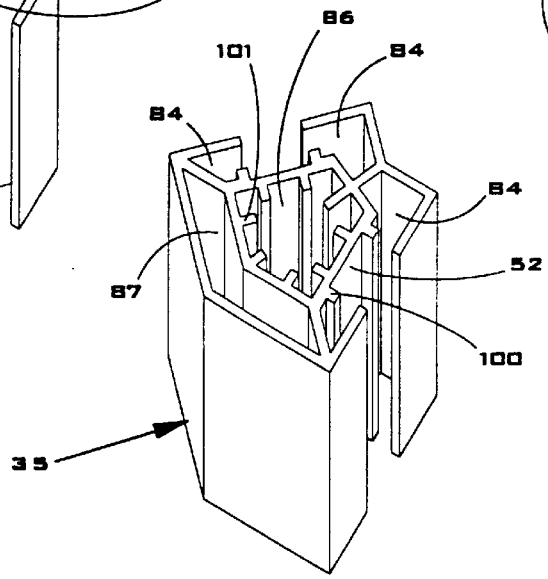
FIG. 12 is a perspective view of a forty-five degree angle upright panel connector.

With reference to FIGS. 4 and 8, the secondary core panels are now ready for placement. These panels 98 will sandwich the center core panel 97 on either side and at the front and rear of the center core. They may be attached with liquid contact adhesives, water-soluble adhesives 62, or double-faced adhesive film.

Each panel composite 60 may differ according to end user needs. For example, users may choose another type of secondary core panel, such as particleboard, honeycomb, medium density fiberboard, plywood or any dense material. These materials can be used to hold nails, screws or objects to affix pictures, paintings or other heavy objects to a surface. Foam or styrofoam can be used as a water resistant material for a lightweight panel, although they are not recommended for hanging objects.

Referring to FIG. 8, the preferred lightweight composite panel is composed of a center core from Extruded Polystyrene (EPS) 97, complemented by two secondary core panels manufactured from double faced honeycomb 98, also called expanded double faced (EDF) panels. This is the most common form of honeycomb and is manufactured from kraft paper (linerboard).

Next, the outer skin layer polyvinyl chloride (PVC) sheets 58 are affixed to the secondary core panels 60 by means of contact adhesive water-soluble adhesives or double-faced adhesive film 62. The outer layer is a rigid lightweight expanded polyvinyl chloride (PVC) sheet having a foamed center and a thin skin having a smooth matte outer surface on either side. PVC sheets come in a various colors and are available thought the United States and Europe.

Figure 3:
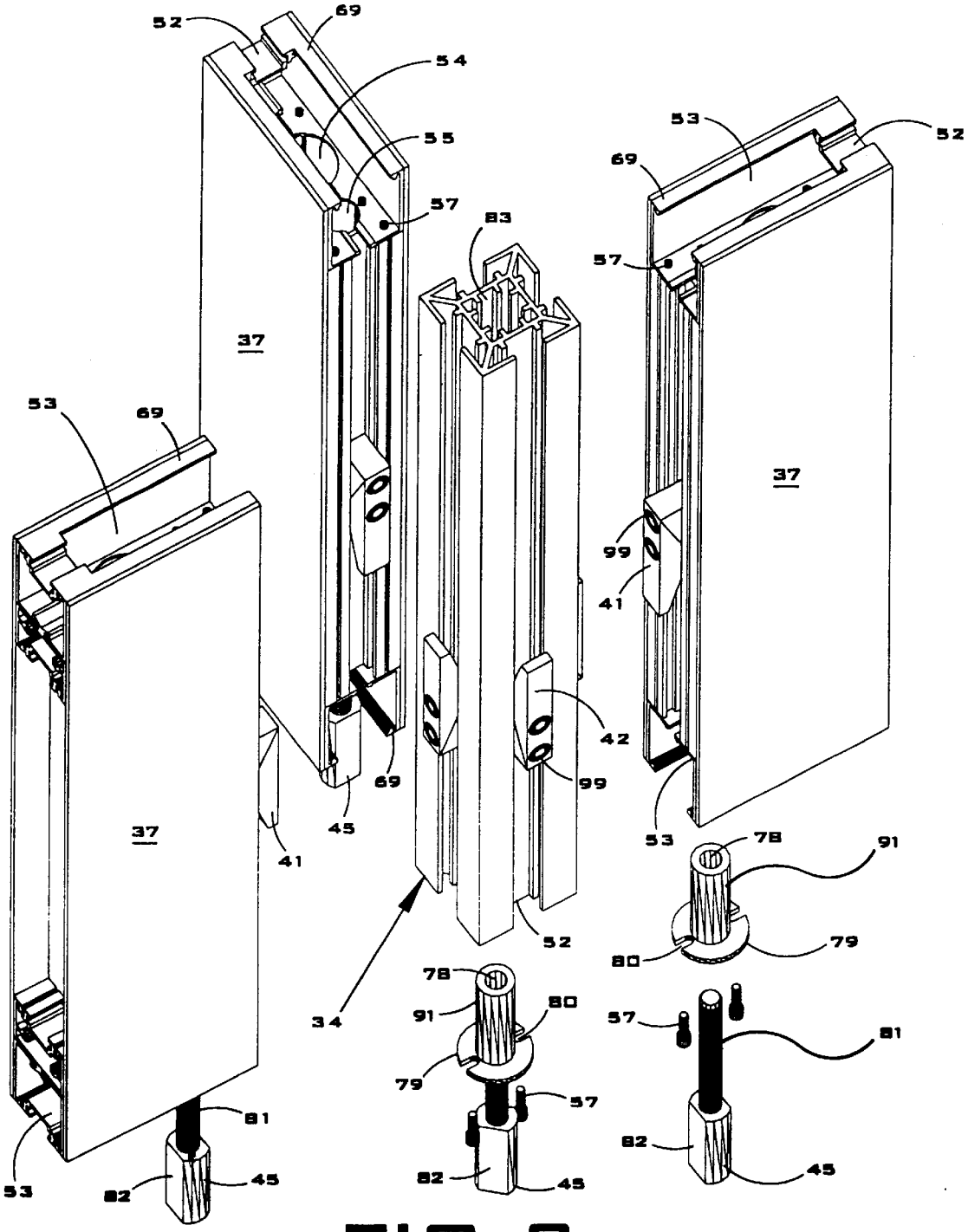
FIG. 3 is a partial perspective view of exhibit panels positioned to connect to a four-way upright panel connector and wedge lock in accordance with the present invention.

Referring to FIGS. 1, 3 and 4, each systems panel 37 is configured to receive two adjustable feet 45. Each adjustable foot 45 is constructed of an elongated aluminum cylinder with two flat surfaces 82 opposing one another. The two flat sides 82 of the elongated cylinder allow the foot 45 to be adjusted with a large open-end wrench. A pre-threaded hole 78 is located in the center of the cylinder. A steel threaded rod 81 is inserted into the pre-threaded hole and tightly fastened into the elongated cylinder, providing a vertical lift to insure all panels remain level with respect to one another and to the floor. The adjustable foot of the present invention includes two flat opposing surfaces which measure approximately three-quarters of an inch. The three-quarter inch flat surfaces on the foot are designed to accept a large wrench permitting better leverage and torque when adjusting and readjusting the height of a plurality of wall panels after they have been assembled. A standard three-quarter inch wrench has a minimum of nine inches in length, twice the size of existing wrenches used to adjust levelers or feet. This area of modular exhibits has been ignored until now.

Each foot sleeve 91 is inserted through the panel extension hole 55 located at opposite ends of the horizontal PVC profile 39-B next to the electrical access hole 54. The foot sleeve 91 is mounted into the panel extension hole 55 and securely fastened at the circular base 79 securely with two assembly screws 57 through groove 80 and into the groove housing 63 located at opposite sides of the vertical profile 40-A, chamber 66.

Panel locks 41 are manufactured from injection molded ABS (Acrylonitrile-Butadiene-Styrene) and preferably consist of an elongated rectangular piece of ABS that tapers to a thin edge and wedges it's way against another on it's tapered plane 47 causing both bodies to tighten by being driven into one another until a tip 48 docks at the docking ledge 49.

Referring to FIGS. 2 and 3 the number of wedge locks required for each panel 37 is determined by the height of the panel 37, and the wedge locks 41 are appropriately positioned. They are typically located at the top, bottom and at the center of each panel 37. Preferably, the wedge locks 41 and 42 are comprised of an inexpensive plastic material, although they can be constructed of more durable materials such as metal. The wedge locks include apertures 50 for the insertion of bolts 99 to secure the locks within the channels. When comprised of plastic material, an area is cored out to create a cavity 51 so that the lock is structurally more rigid and durable. Three upwardly directed locks 41 are mounted to one side of a panel in the vertical extrusion channel 52 in the lock up position. Three downwardly directed locks 42 are mounted to the vertical extrusion channel 52 of the opposite side of the panel 37 with the lock 42 in the facing down position. A standard panel height is eight feet typically requiring six locks. Due to the angle of the tapered plane 47 located on the rear side of each panel lock 41 and 42 panels 37 are tightly pulled together medially, creating a seamless effect between wall panels 37 and vertical panel connectors. After the panels 37 are completely assembled they are hung into one another creating a solid wall such that a seamless effect is achieved.

Referring to FIGS. 9–13, various angles are achieved by using upright right-angled connectors 32 and other various angled connectors 33–36 that enable the system to achieve variable angles and height. Although four configurations of a multi-faceted vertical panel connector 33–36 are illustrated, each panel connector 33–36 having at least two open-faced grooves at predetermined angles for the connection of two or more panels 37, it should be understood by the reader that other configurations are possible and fall within the scope of the invention. Although the panel connectors 33–36 may include multiple facets, not all of the facets may include an open-faced channel 52. In order to enhance the structural rigidity of the connector 33–36, facets not having an open-faced connector or channel are enclosed so as to create hollows or channels 85–87. Given the fact that right-angle panel configurations create tension at the point of the angle, a strong right angle connection between the panels is required. It has been found that aluminum is inexpensive to extrude, and provides a great deal of strength for right and forty-five degree connections. Therefore, extruded aluminum alloys preferably used to create the connectors 33–36 to prevent the risk of breakage and failure. Wedge fasteners 41 and 42 are secured to each upright connector with the use of machine screws 99 in the aluminum extrusion channel 52 between the exterior locator notches 100 providing a secure alignment.

Figure 15:
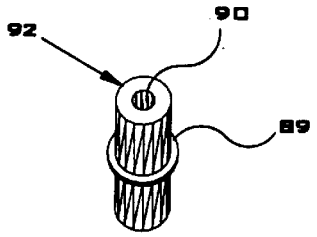
FIG. 15 is a is a perspective view of one upright panel connector extension.
Figure 13:
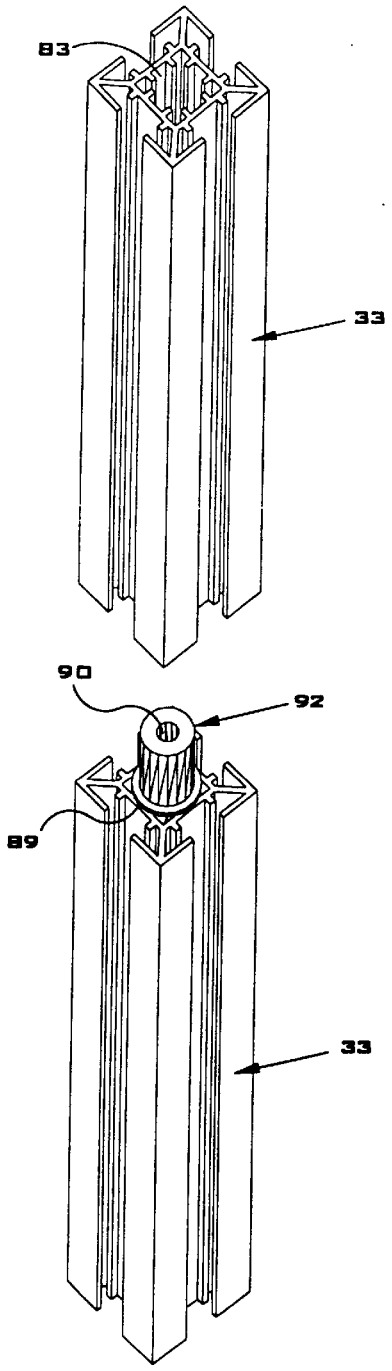
FIG. 13 is a perspective view of an upright panel connector extension and two four-way right angle upright panel connectors.

Referring to FIGS. 13 and 15, upright extensions 92 are used to extend the vertical height of upright panel connectors 32–36 and exhibit system solid panels 37 and framed panels 38. Each extension is produced from an elongated cylindrical surface measuring approximately one-half of an inch in diameter with a circular base 89 located at center measuring three-quarters of an inch in diameter. A lower end is positioned into the top of an upright connector channel 83 centered between the interior locator notch 101, while an upper end is positioned into the upright channel 83 of another upright connector. Two upright extensions 92 are required in extending solid panels 37 and framed panels 38 on top of one another. The lower end of an upright extension 92 is positioned into the panel extension hole 55 located on the upper edge of each solid panel 37 and framed panel 38, while upper ends of the upright extension 92 are fitted into the bottoms of the upper end. This procedure requires the removal of foot sleeves 91 that may be attached to a solid panel 37 or framed panel.

Referring to FIG. 6, electrical cables 96 are installed after the wall panels 37 are in place. All cables and cords 96 can be inserted into the cutaway channel 69 by inserting the access cap 93 having an external wall 94, and locking flanges 95 around the cables 96 and into the cutaway channel 69 located at opposite ends of profile 39-B.

Figure 14:
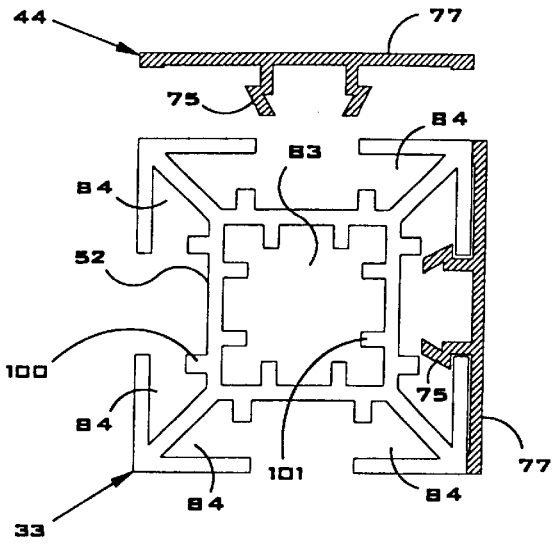
FIG. 14 is a top cross-sectional view of one four-way right angle upright panel connectors and two panel end caps.

Referring to FIGS. 1, 7 and 14, end caps 44 provide a finished surface to exposed edges of solid panels and upright connectors. Each end cap 44 is composed of an end cap face 77 and locking profile 75. The locking profile 75 is inserted between the two hollow corners 84 of upright connectors 32–35, and in channel 52, slot 61 of solid panel 37 and framed panel 38 frame members. Produced from extruded flexible PVC plastics, end cap 44 is non-flammable.

From the foregoing description, it will be appreciated that the present invention solves many of the problems and disadvantages present in the prior art exhibit panel system. Use of the present invention allows the builder to use different composite panels for particular applications. These panels are attached in such a manner that they are connected not only at the top and bottom, but also along their length and are adjustable in height to form a secure wall having a seamless appearance. As electrical cables can be run along the base or top of any or all of the panels of the present invention, builders can make last minute changes to the exhibit on the show floor. The locking system of the present invention enable a user to hang prefabricated wall panels of great size and weight. Using the polyvinyl chloride framework and aluminum alloy connectors, the systems achieves a seamless variable surface wall system capable of many heights and angles. Each panel composite may differ according to user discretion. For example, users may choose particle-board, honeycomb, fiberboard, metal, glass, etc. In fact, each panel composite may differ according to end user requirement. The wedge locking system allows quick assembly of panels and connectors with tight medial contact between wall panels without the requirement of special tools. Based upon the simplicity and strength of the wedge lock, it is conceivable that wall panels of great size and weight can be hung into one another with great ease.

Although several embodiments have been described in detail for purposes of illustration, various modifications may be made to each without departing from the scope and spirit of the invention. Accordingly, the invention is not to be limited, except as by the appended claims.

What is claimed is:

1. A modular exhibit panel system, comprising:

a first panel having a first channel defining a vertical edge thereof, and a first wedge secured within the first channel;

a second panel having a second channel defining a vertical edge thereof, and a second wedge secured within the second channel; and a multi-faceted panel connector having channels in at least two facets thereof, and third wedges secured within the panel connector channels;

wherein the first and second panels are securely associated with one another by placing the first wedge in the first panel channel in an orientation generally opposite the third wedge within the panel connector channel, and placing the second wedge in the second panel channel so as to be oriented generally opposite the third wedge within the panel connector channel, so that upon sliding the first panel channel and second panel channel relative to the panel connector channels, the first and second wedges interlock with the third wedges causing the first and second panels to be connected to the panel connector; and wherein the first and second panels each include an outer frame comprised of hollow internal and external vertical members slidably connected to one another, and hollow internal and external horizontal members slidably connected to one another, the horizontal and vertical members being arranged to form the frame.

2. The panel system of claim 1, wherein the first, second and third wedges each include a base secured to an inner wall of their respective channels and a tapered finger extending from the base, wherein the finger and base form a ledge configured to accept a tip of a finger of another wedge.

3. The panel system of claim 1, wherein the first, second and third wedges each include apertures for acceptance of a bolt therethrough and into their respective channels to securely hold the wedges in place within the channels.

4. The panel system of claim 1, wherein the first, second and third wedges each include a cavity therein.

5. The panel system of claim 1, wherein each channel includes projections extending from an inner wall thereof for securing a wedge within the channel.

6. The panel system of claim 1, wherein the panel connector includes a central aperture and a plurality of projections extending into the central aperture to facilitate a frictional fit with either a foot member or a vertical extension member.

7. The panel system of claim 1, wherein the internal horizontal and vertical members include an open-faced channel directed into the frame, and the external horizontal and vertical members include an open-faced channel directed outward with respect to the frame.

8. The locking system of claim 1, wherein the external horizontal members include an aperture positional over an internal vertical member for the insertion of electrical or telephone cable into the hollow vertical member.

9. The locking system of claim 1, wherein the external horizontal members include apertures configured to securely receive a foot member.

10. A modular exhibit panel system, comprising:

a first panel including hollow internal and external vertical members slidably connected to one another, and hollow internal and external horizontal members slidably connected to one another, the horizontal and vertical members being arranged to form a first panel frame, the internal horizontal and vertical members including a first open-faced channel directed into the frame, and a first open-faced channel directed outward with respect to the first panel frame;

a first wedge secured within the first outwardly directed channel of a vertical member of the first panel frame, the first wedge including a base secured to an inner wall of the first outwardly directed channel and a tapered finger extending from the base, wherein the finger and base form a ledge;

a second panel including hollow internal and external vertical members slidably connected to one another, and hollow internal and external horizontal members slidably connected to one another, the horizontal and vertical members being arranged to form a second panel frame, the internal horizontal and vertical members including a second open-faced channel directed into the frame, and a second open-faced channel directed outward with respect to the second panel frame;

a second wedge secured within the second outwardly directed channel of a vertical member of the second panel frame, the second wedge including a base secured to an inner wall of the second outwardly directed channel and a tapered finger extending from the base, wherein the finger and base form a ledge; and a multi-faceted panel connector having channels in at least two facets thereof, and third wedges secured within the panel connector channels, the third wedges including a base secured to an inner wall of the panel connector channel and a tapered finger extending from the base, wherein the finger and base form a ledge;

wherein the first and second panels are securely associated with one another by placing the first wedge in the first outwardly directed channel of a vertical member of the first panel frame in an orientation generally opposite the third wedge within the panel connector channel, and placing the second wedge in the second outwardly directed channel of the vertical member of the second panel frame so as to be oriented generally opposite the third wedge within the panel connector channel, so that upon sliding the first outwardly directed channel of the vertical member of the first panel frame and second outwardly directed channel of the vertical member of the second panel frame relative to the panel connector channels, the first and second wedges interlock with the third wedges causing the first and second panels to be connected to the panel connector.

11. The panel system of claim 10, wherein the first, second and third wedges each include apertures for acceptance of a bolt therethrough and into their respective channels to securely hold the wedges in place within the channels.

12. The panel system of claim 10, wherein the first, second and third wedges each include a cavity therein.

13. The panel system of claim 10, wherein each channel includes projections extending from an inner wall thereof for securing a wedge within the channel.

14. The panel system of claim 10, wherein the panel connector includes a central aperture and a plurality of projections extending into the central aperture to facilitate a frictional fit with either a foot member or a vertical extension member.

15. The locking system of claim 10, wherein the external horizontal members include an aperture positional over an internal vertical member for the insertion of electrical or telephone cable into the hollow vertical member, and an aperture configured to securely receive a foot member.

16. A locking system, comprising:

a first wedge secured within a first channel of a first object, the first wedge including an open-faced cavity therein and a base having an aperture extending from the cavity for acceptance of a bolt therethrough to securely hold the wedge to an inner wall of the first channel, and a tapered finger extending from the base, wherein the finger and base form a ledge; and a second wedge secured within a second channel of a second object, the second wedge including an open-faced cavity therein and a base having an aperture extending from the cavity for acceptance of a bolt therethrough to securely hold the wedge to an inner wall of the second channel, and a tapered finger extending from the base, wherein the finger and base form a ledge;

wherein the first wedge is placed in the first channel such that the finger is downwardly directed, and the second wedge is placed in the second channel such that the finger is directed upwardly so that upon sliding the first and second channels relative to one another, the first and second wedges interlock with one another causing the first and second objects to be connected; and wherein the first and second objects comprise either a modular exhibit panel or an elongated panel connector.

17. The locking system of claim 16, wherein the panel connector is multi-faceted and includes an open-faced channel in at least two facets thereof.

18. The locking system of claim 17, wherein the panel connector includes projections extending from an internal wall of the channel for securing a wedge within the channel.

19. The locking system of claim 17, wherein the panel connector includes a central aperture and a plurality of projections extending into the central aperture to facilitate a frictional fit with either a foot member or a vertical extension member.

20. The locking system of claim 16, wherein the modular exhibit panel includes an outer frame comprised of hollow internal and external vertical members slidably connected to one another, and hollow internal and external horizontal members slidably connected to one another, the horizontal and vertical members being arranged to form the frame.

21. The locking system of claim 20, wherein the internal horizontal and vertical members include an open-faced channel directed into the frame, and the external horizontal and vertical members include an open-faced channel directed outward with respect to the frame.

22. The locking system of claim 20, wherein the external horizontal members include an aperture positional over an internal vertical member for the insertion of electrical or telephone cable into the hollow vertical member.

23. The locking system of claim 20, wherein the external horizontal members include apertures configured to securely receive a foot member.

24. A modular exhibit panel system, comprising:

a first panel having a first channel defining a vertical edge thereof, and a first wedge secured within the first channel;

a second panel having a second channel defining a vertical edge thereof, and a second wedge secured within the second channel; and a multi-faceted panel connector having channels in at least two facets thereof, and third wedges secured within the panel connector channels;

wherein the first and second panels are securely associated with one another by placing the first wedge in the first panel channel in an orientation generally opposite the third wedge within the panel connector channel, and placing the second wedge in the second panel channel so as to be oriented generally opposite the third wedge within the panel connector channel, so that upon sliding the first panel channel and second panel channel relative to the panel connector channels, the first and second wedges interlock with the third wedges causing the first and second panels to be connected to the panel connector; and wherein the panel connector includes a central aperture and a plurality of projections extending into the central aperture to facilitate a frictional fit with either a foot member or a vertical extension member.

25. A modular exhibit panel system, comprising:

a first panel having a first channel defining a vertical edge thereof, and a first wedge secured within the first channel;

a second panel having a second channel defining a vertical edge thereof, and a second wedge secured within the second channel; and a multi-faceted panel connector having channels in at least two facets thereof, and third wedges secured within the panel connector channels;

wherein the first and second panels are securely associated with one another by placing the first wedge in the first panel channel in an orientation generally opposite the third wedge within the panel connector channel, and placing the second wedge in the second panel channel so as to be oriented generally opposite the third wedge within the panel connector channel, so that upon sliding the first panel channel and second panel channel relative to the panel connector channels, the first and second wedges interlock with the third wedges causing the first and second panels to be connected to the panel connector; and wherein each channel includes internal, parallel projections extending from an inner wall thereof for guiding and securing a wedge within the channel.

* * * * *